United States Patent [19]

von Bonin et al.

[11] Patent Number: 4,499,153

[45] Date of Patent: Feb. 12, 1985

[54] SIZES

[75] Inventors: Wulf von Bonin, Leverkusen; Peter Mummenhoff, Cologne; Ulrich Beck, Bornheim; Heinz Bäumgen, Leverkusen, all of Fed. Rep. of Germany

[73] Assignee: Bayer Aktiengesellschaft, Leverkusen, Fed. Rep. of Germany

[21] Appl. No.: 466,708

[22] Filed: Feb. 15, 1983

[30] Foreign Application Priority Data

Mar. 6, 1982 [DE] Fed. Rep. of Germany ..... 3208139

[51] Int. Cl.[3] ..... C08L 91/00; D21D 3/00; B32B 27/06

[52] U.S. Cl. ..... 428/479.6; 106/243; 162/164.6; 260/404.5

[58] Field of Search ..... 106/243; 162/164.6; 260/404.5; 525/423; 428/479.6

[56] References Cited

U.S. PATENT DOCUMENTS

| | | | |
|---|---|---|---|
| 2,149,273 | 3/1939 | Carothers | 528/342 |
| 2,272,466 | 2/1942 | Hummel | 260/404.5 |
| 3,816,366 | 6/1974 | Laudise | 260/404.5 |
| 3,893,885 | 7/1975 | Ziemann | 162/164.6 |
| 3,900,335 | 8/1975 | Beck | 106/213 |

FOREIGN PATENT DOCUMENTS

| | | |
|---|---|---|
| 1771293 | 11/1971 | Fed. Rep. of Germany . |
| 7412868 | 8/1974 | France . |

*Primary Examiner*—Theodore Morris

*Attorney, Agent, or Firm*—Sprung, Horn, Kramer & Woods

[57] ABSTRACT

New products having excellent sizing action, in particular on paper are obtained by reacting $\alpha,\beta$-unsaturated carboxylic acids or their reactive derivatives (such as, for example, esters or anhydrides) with amide-amines of higher carboxylic acids at temperatures above 120° C.

The new products are used in size formulations, preferably as aqueous alkaline and, in particular, aqueous ammoniacal, dispersions.

18 Claims, No Drawings

SIZES

The present invention relates to new products having a sizing action. The new products can be obtained by reacting α,β-unsaturated carboxylic acids or their reactive derivatives (such as, for example esters or anhydrides) with amide-amines of higher carboxylic acids at temperatures above 120° C.

The invention also relates to a process for preparing the abovementioned products and to size formulations (preferably aqueous alkaline dispersions) which contain the abovementioned reaction products.

The invention finally relates to sizing processes using size formulations according to the invention.

A size in particular a paper size cannot in general satisfy all the wishes of commercial practice at one and the same time, so that any existing size represents a compromise in that it, perhaps, sizes well but has a short shelf life or is difficult to handle or in that it works either particularly well or particularly unsatisfactorily only on pre-sized or on unfilled or alum-containing paper or only on regenerated paper or on mechanical woodpulp paper or clay-containing paper, with the sizing action taking effect perhaps only after a certain ripening time or immediately, there being more or less firm evidence of brightener effect and there being evidence of yellowing, foaming in the liquor or sensitivity to hard water.

There thus still exists, in particular in the field of surface sizing, a considerable demand for sizes which have a good sizing action, impart this action not only in the case of chalk-containing or alum-free papers but, in particular, also in the case of alum-and wood- containing papers and do not foam in the liquor.

By providing the products according to the invention, it is possible to prepare size formulations which act at the surface do not tend to foam and which are highly effective not only on alum-free and/or chalk-containing paper but also on alum-and/or kaolin-and/or wood-containing paper. As has already been mentioned above the new size formulations were obtained by reacting α,β-unsaturated carboxylic acids or their reactive derivatives with amide-amines of higher carboxylic acids at temperatures above 120° C. (in particular above 140° C.) and dispersing the addition products in an aqueous alkaline medium.

It is surprising that the procedure characterised above gives excellent sizes, since to combine the amide-amines with α,β-unsaturated carboxylic acids at temperatures below 100° C. gives products having uninteresting sizing effects. Since also, the reaction of, for example triethylenetetramine with stearic acid (as starting components for the amide-amine component), which involves the reaction of 2 mols of acid with 1 mol of amine to give a basic diamide, comes to a virtual standstill even at temperatures around 160° C., it was not foreseeable since steric reasons are probably involved here that it would be possible to obtain a problem-free reaction between, in turn, α,β-unsaturated carboxylic acids (or their reactive derivatives) used in addition in this case and the amide-amine.

It is also surprising that relatively low molecular weight substances of the type likely among reaction products according to the invention give sizing actions in the surface of the paper which are so excellent that practical experience had made them seem possible only for products the molecular weight of which is at the relatively high level generally true of surface sizes. The addition products according to the invention have mean molecular weights of about 500 to about 3,500, determined by the osmotic molecular weight determination method.

Within the scope of the present invention, sizes for paper are understood as meaning those which can be used in the pulp and/or on the surface and the use in surface sizing is preferably effected from the size press.

The papers and boards or cardboards can have been prepared from a very wide variety of pulps, for example from sulphite, sulphate, anthraquinone, mechanical wood, regenerated, soft wood, hard wood pulp or with the addition of synthetic pulps. The papers can also contain a very wide variety of fillers, such as, for example, chalk, kaolin or talc, as well as other customary auxiliaries and dyestuffs corresponding to the state of the art, such as disperse or solution or pigment dyestuffs, other sizes, starches or wet strength or retention agents, and other additives such as, for example, alum, gypsum and the like. Amide-amines are understood as meaning those acid amides which, in addition to at least one amide group, also contain at least one amino group in the molecule, this amino group being primary, tertiary or, preferably, secondary.

The expression higher carboxylic acids designates aromatic, aliphatic, cyclic and, in particular, aliphatic carboxylic acids having 10–26 C atoms. Of these, for example resin acids, but in particular aliphatic fatty acids or natural fatty acids having 10–26, preferably 12–18, C atoms, or their mixtures, are suitable. Of these, in turn, particularly valuable fatty acids have melting points above 30° C. Suitable fatty acid mixtures contain in addition to, in particular, stearic acid also tallow, coconut, palmitic, abietic, arachidic, erucic, behenic, ricinoleic and oleic acid, hydrogenated oleic acid, tall oil fatty acids or their hydrogenation products and other fatty acids, for example accessible by oxo synthesis.

Amide-amines are prepared by reacting higher carboxylic acids with at least bifunctional amines, preferably with at least bifunctional primary-secondary diamines, such as, for example, N-methylpropylenediamine, N-ethylpropylenediamine, N-cyclohexylpropylendiamine or the corresponding N-alkylethylenediamines, for example N-ethylethylenediamine, or N-hydroxyethylethylenediamine, but in particular with polyethylenepolyamines having 2–6 amino groups per mol, such as diethylenetriamine, tri ethylenetetramine, tetraethylenepentamine or pentaethylenehexamine, which can preferably be used in the form of their technical grades. The corresponding technical propyleneamines are also suitable. Technical triethylenetetramine is of particular interest.

Examples of accompanying substances which, owing to their similar boiling behaviour, can occur in technical polyethylenepolyamines, which are generally purified by distillation, are aminoethylpiperazine, trisaminoethylamine, N,N' bisaminoethylpiperazine, aminoethylated N-aminoethylpiperazines in the form of various isomers and a number of unidentified other contaminants in amounts of usually less than 10% by weight. The technical mixtures should contain at least 20% by weight, and preferably over 40% by weight, of the linear compound which accords to the formula. According to the process, it is also possible to use mixtures of technical polyalkylenepolyamines of various boiling ranges.

The reaction of the polyamines with the higher carboxylic acids, although working in solvents or dispersing agents is of course also suitable, is preferably carried out in the melt at temperatures around 150°–200° C., if appropriate under protective gas (preferably $N_2$), water splitting off and the desired amide-amines forming in a way familiar to a skilled worker.

0.8–1.2 mols of the higher fatty acid are preferably used per free primary amino group in the mol of amine, although upward and downward deviations from this ratio, for example between about 0.5 and 2 mols, are also possible. The amide-amine of about 1 mol of technical triethylenetetramine and about 2 mols of technical stearic acid has been found to be particularly suitable.

Suitable $\alpha,\beta$-unsaturated carboxylic acids are monocarboxylic and polycarboxylic acids, which are also used in the form of their derivatives, such as, for example, halides, esters or partial esters with lower aliphatic alcohols having 1–6 C atoms, but, in particular in the case of dicarboxylic acids, in the form of their anhydrides. Examples of such acids which are used are methacrylic acid, acrylic acid, crotonic acid, tumaric acid, maleic acid and itaconic acid, of which acrylic acid and, in particular, maleic acid or maleic anhydride are particularly highly suitable.

The $\alpha,\beta$-unsaturated carboxylic acids are reacted with the amide-amines in amounts of 0.5–1.8, in particular 0.8–1.3 mols per amino group of the amide-amine.

The reaction is carried out at temperatures of 120° C. to 250° C., preferably 130°–170° C., and the exclusion of oxygen, that is working under protective gases, such as, for example, $N_2$ or $CO_2$, has proved suitable to avoid discolorations.

The reaction can be carried out in the melt or in a solution or dispersing medium, if appropriate under pressure. It has been found to be advantageous first to use water as the dispersing medium and then to distil off this water, for example when working without excess pressure, in the course of the reaction at increasing temperatures, if appropriate using defoamers.

The reaction products of amide-amines and $\alpha,\beta$-unsaturated carboxylic acids require reaction times between 0.5 and about 8 hours, usually reaction times of 1 to 5 hours are chosen.

In a particularly preferable embodiment for preparing the addition products according to the invention and size formulations, those amide-amines of higher carboxylic acids are used which can be prepared by reacting polyethylenepolyamines having 3 to 6 amino groups per mol with aliphatic and/or cyclic carboxylic acids having 10 to 26 C atoms per mol, technical triethylenetetramine is used as the polyethylenepolyamine, and technical fatty acid mixtures which essentially contain stearic acid are used as the aliphatic carboxylic acid.

Furthermore, the $\alpha,\beta$-unsaturated carboxylic acid used is acrylic acid and/or methacrylic acid and/or maleic acid and/or fumaric acid and/or their reactive derivatives, such as, for example, carboxylates, acid chlorides or, if appropriate, anhydrides, the reaction is carried out in the presence of water, under protective gas and with the addition of maleic anhydride, and an aqueous ammonia solution is used as a basic dispersing medium.

To prepare size formulations according to the invention, the reaction products of $\alpha,\beta$-unsaturated carboxylic acids (or their reactive derivatives) with amide-amines of higher carboxylic acids are dispersed in an aqueous basic medium, for which temperatures of 5° to 95° C., preferably 15° to 80° C., are used.

The dispersions have solids concentrations between 5 and 40, preferably 10–25, % by weight. It is surprising that the size type according to the invention can have lower viscosities at room temperature than at elevated temperatures. This fact makes it easier in practice to meter the size.

Bases used to standardise the aqueous alkaline dispersions are inorganic or organic bases, such as NaOH, KOH, $Na_2CO_3$, triethylamine, mono-, di- or triethanolamine or the corresponding propanolamines. Ammonia is particularly highly suitable and also preferably used.

The bases are used in amounts which are such that the pH value of the dispersions is between 6 and 11, preferably 7 and 9.

Size formulations according to the invention have the advantage of combining very high effectiveness on papers which are difficult to size, for example wood-containing or regenerate-containing papers, with unlimited shelf life in the form of their aqueous formulations.

Size formulations according to the invention can be used without but also with customary additives. Examples of such additives which may be used are alum, cationic or anionic auxiliaries, for example based on cationic starch, quarternised polyamines, quaternised polyamideamines, quaternised basic formaldehyde resins, methylcellulose, carboxymethylcellulose; ligninsulphonic acids, starches and polysaccharides of most diverse origin, xanthan, pullulan, chitosan, polymers or copolymers of (meth)acrylic acid, (meth)acrylamide, maleic, fumaric or itaconic acid or other polymers and copolymers having carboxyl or sulphonic acid groups which may be in salt form, or collagen, gelatine, alginates and caragenates.

The effectiveness of sizes according to the invention is not impaired by whiteners. The aqueous formulations may also be prepared without emulsifying auxiliaries although the use of such auxiliaries may be contemplated.

The sizes, alone or combined with other sizes, are particularly highly suitable for surface-sizing paper, but of course they can also be used for pulp-sizing. They can be used not only in the case of chalk-containing or kaolin-containing papers, but also in the case of those which do not contain a filler or contain a filler of different type, such as for example, talc or gypsum. They are also suitable for sizing cellulosic materials, such as board, textile material, leather, cardboard or chipboards or insulating boards.

Below the invention is intended to be illustrated by examples. The indicated parts and percentages are parts and percentages by weight unless otherwise stated.

PREPARATION OF SIZES

Size 1

170 parts of technically pure commercially available stearic acid (molar ratio about 2.1) are slowly heated to 180° C. together with 43.8 parts of technical triethylenetetramine (linear fraction about 70.4%, branched fraction about 14.4%, piperazine content about 9.0% and the rest being other fractions) under nitrogen and while the water of reaction is being distilled off, and the mixture is stirred at 180° C. for about 5 hours. A basic amide-amine is obtained which has an acid value of 2.9 and beings to melt at about 87° C.

136.8 parts of amide-amine prepared as above are melted at 130° C. under nitrogen, and a solution of 49 parts of maleic anhydride in 200 parts of water is then added with stirring. The mixture is then heated to 170° C., under nitrogen and while water is being distilled off, and stirred at this temperature for 5 hours. The polymer melt is then discharged from the reaction vessel and solidifies to give a brittle wax.

The wax has a melting point of about 98° C.

30 parts of the abovementioned wax are stirred for 3 hours at 50° C. in a mixture of 15 parts of concentrated aqueous ammonia (about 24% strength) and 155 parts of water, and a viscous, about 15% strength dispersion forms, which becomes mobile on cooling down to room temperature and can be used directly as a size.

Molecular weight data: the molecular weight is determined osmotically at 82° C. on a solution in toluene, and is found to be 2,520.

Size 2

170 parts of technically pure, commercially available stearic acid (molar ratio about 2:1) are slowly heated to 180° C. together with 43.8 parts of technical triethylenetetramine (linear fraction about 70.4%, branched fraction about 14.4%, piperazine content about 9.0% and the rest being other fractions), under nitrogen and while the water of reaction is being distilled off, and the mixture is stirred at 180° C. for about 5 hours. A basic amide-amine is obtained which has an acid value of 2.9 and begins to melt at about 87° C.

136.8 parts of amide-amine prepared as above are melted at 130° C. under nitrogen, and a solution of 58 parts of fumaric acid in 200 parts of water is then added with stirring. The mixture is then heated to 170° C., under nitrogen and while water is being distilled off, and stirred at this temperature for 5 hours. The polymer melt is then discharged from the reaction vessel and solidifies to give a brittle wax.

The wax has a melting point of about 89° C.

30 parts of the abovementioned wax are stirred for 3 hours at 50° C. in a mixture of 15 parts of concentrated aqeuous ammonia (about 24% strength) and 155 parts of water and a viscous, about 15% strength dispersion forms, which becomes mobile on cooling down to room temperature and can be used directly as a size.

Molecular weight data: the molecular weight is determined osmotically at 82° C. in toluene, and is found to be 2,020.

Size 3

170 parts of technically pure, commercially available stearic acid (molecular ratio about 2.1) are slowly heated to 180° C. together with 43.8 parts of technical triethylenetetramine (linear fraction about 70.4%, branched fraction about 14.4%, piperazine content about 9.0% and the rest being other fractions), under nitrogen and while the water of reaction is being distilled off, and the mixture is stirred at 180° C. for about 5 hours. A basic amide-amine is obtained which has an acid value of 2.9 and begins to melt at about 87° C.

136.8 parts of amide-amine prepared as above are melted at 130° C. under nitrogen, and a solution of 49 parts of maleic anhydride in 200 parts of ethanol is then added with stirring. The mixture is then heated to 170° C., under nitrogen and while water is being distilled off, and stirred at this temperature for 5 hours. The polymer melt is then discharged from the reaction vessel and solidifies to give a brittle wax.

The wax has a melting point of about 79° C.

30 parts of the abovementioned wax are stirred for 3 hours at 50° C. in a mixture of 15 parts of concentrated aqueous ammonia (about 24% strength) and 155 parts of water and a viscous, about 15% strength dispersion forms, which becomes mobile on cooling down to room temperature and can be used directly as a size.

Molecular weight data: determined as in 1 as 1,940.

Size 4

170 parts of technically pure, commercially available stearic acid (molar ratio about 2:1) are slowly heated to 180° C. together with 43.8 parts of technical triethylenetetramine (linear fraction about 70.4%, branched fraction about 14.4%, piperazine content about 9.0% and the rest being other fractions), under nitrogen and while the water of reaction is being distilled off, and the mixture is stirred at 180° C. for about 5 hours. A basic amide-amine is obtained which has an acid value of 2.9 and begins to melt at about 87° C.

68.4 parts of the amide-amine described above are heated at 170° C. for 4 hours together with 30 parts of acrylic acid, under nitrogen. The polymer melt is then discharged from the reaction vessel and solidifies.

Melting point of the addition product: about 90° C.

30 parts of the abovementioned addition product are stirred for 3 hours at 50° C. in a mixture of 15 parts of concentrated aqueous ammonia (about 24% strength) and 155 parts of water and a viscous, about 15% strength dispersion forms, which becomes mobile on cooling down to room temperature and can be used directly as a size.

Molecular weight data: determined as in 1 as 1,860.

Comparative size

Size A of German Patent Specification No. 2,304,586 is used for comparison, and it is an ammoniacal aqueous formulation of a subsequently imidated copolymer of maleate, styrene and acrylic acid.

Foaming behaviour

To determine the foaming behaviour of sizes according to the invention, these were investigated in a laboratory foaming test apparatus which, approximately, reproduces the conditions in a size press of a paper machine. In this piece of equipment, the sizing liquor, which contains the size under test, starch and possibly further additives, is drawn from a thermostatted beaker at a constant rate through a line located at the bottom of this beaker, and pumped back into the beaker through a steel tube which passes through the lid of the beaker. This steel tube ends 150 mm above the surface of the liquid, so that the sizing liquor impinges in a direct jet on the surface of the liquid, which can cause foaming. The foam volume, in ml, measured above the surface of the sizing liquor after a certain time thus represents a measure of the foaming tendency of the liquid under investigation.

The table which follows provides a survey of the foaming behaviour, investigated with the aid of the above-mentioned test apparatus, of surface sizes 1–4 as described compared to the product prepared in accordance with German Patent Specification No. 2,304,586. For this comparison, in each case 700 ml of an aqueous sizing liquor were prepared which contained 5% by weight of a commercially available starch and 0.19% by weight of the size under investigation. The solutions were pumped through the test apparatus at 60° C. and at a rate of 200 liters/h. The foam volume building up above the surface of the liquid in the course of the test was measured in ml at intervals of 5 min..

TABLE 1

| | Foam volume in ml after a time of | | | | | |
|---|---|---|---|---|---|---|
| | 5 | 10 | 15 | 20 | 25 | 30 min |
| Comparative size* | 200 | 500 | 900 | 1,200 | 1,600 | 2,000 |
| Size 1 | 0 | 0 | 0 | 0 | 0 | 0 |
| Size 2 | 0 | 0 | 0 | 0 | 0 | 0 |
| Size 3 | 0 | 0 | 0 | 0 | 0 | 0 |
| Size 4 | 0 | 0 | 0 | 0 | 0 | 0 |

*Size A of German Patent Specification 2,304.586

Application Examples

The Application Examples are intended to demonstrate the good sizing action of sizes according to the invention on papers of differing mterial composition. In these examples, the Cobb value (according to DIN 53,132) was determined as a measure of specific sizing.

The papers used had the following composition.

(a) Alum-free paper

50% of soft wood pulp, 50% of hard wood pulp, 9.5% of clay ash, pH value in the breast box: 7.5; wet absorption in a laboratory size press: about 85%; paper weight: 80 g/m$^2$.

(b) Alum-containing paper

50% of soft wood pulp, 50% of hard wood pulp, 1% of alum, 11.2% of clay ash, pH value in the breast box: 4.4; wet absorption: about 80%; paper weight: 80 g/m$^2$.

(c) Pre-sized paper

50% of soft wood pulp, 50% of hard wood pulp, 1% of alum, 0.1% of Bewoid size, 11.1% of clay ash, pH value in the breast box: 4.5; wet absorption: about 80%; paper weight 80 g/m$^2$.

(d) Chalk-containing paper

50% of soft wood pulp, 50% of hard wood pulp, 7.9% of chalk ash, pH value in the breast box: 7.5; wet absorption: about 90%; paper weight: 75 g/m$^2$.

(e) Wood-containing paper

40% of soft wood pulp, 60% of mechanical wood pulp, 14.1% of clay ash, pH value in the breast box: 4.5; wet absorption: about 40%, paper weight: 75 g/m$^2$.

The papers were sized on a laboratory size press from Messrs. Mathis, Zurich/Switzerland, Type HF. The sizing liquor used was a solution of 5% by weight of commercially available starch and 0.2–0.4% by weight of the size under test (calculated as 100% pure active substance), in water.

The surface-sized papers were dried on a drying cylinder in the course of one minute at about 100° C. The papers were conditioned for 2 hours at room temperature before the sizing test.

TABLE 2

| | Size type: | | | | | |
|---|---|---|---|---|---|---|
| | A | B | 1 | 2 | 3 | 4 |
| Type of paper: | Cobb values in g/m$^2$, 60 sec: | | | | | |
| (a) alum-free | 0.4 | 24.1 | 21.3 | 22.6 | 21.0 | 23.5 |
| (b) alum-containing | 0.2 | 20.0 | 17.9 | 20.1 | 20.3 | 21.0 |
| (c) pre-sized | 0.2 | 18.3 | 17.5 | 21.1 | 19.2 | 21.9 |
| (d) chalk-containing | 0.4 | 23.3 | 22.8 | 22.6 | 23.5 | 22.3 |

TABLE 2-continued

| | Size type: | | | | | |
|---|---|---|---|---|---|---|
| | A | B | 1 | 2 | 3 | 4 |
| Type of paper: | Cobb values in g/m$^2$, 60 sec: | | | | | |
| (e) wood-containing | 0.2 | 21.7 | 18.3 | 22.0 | 21.8 | 22.2 |

In the above table:

A denotes amount of size used, expressed in percent by weight of the liquor

B denotes size A of German Patent Specification 2,304,586

1 = size 1
2 = size 2
3 = size 3
4 = size 4
} in accordance with the present patent application The data given are Cobb values in g/m$^2$, 60 seconds, determined according to DIN 53,132. A lower Cobb value means better sizing action. Comparative experiment=ink flotation test (IFT):

TABLE 3

| | Size type: | | | | | |
|---|---|---|---|---|---|---|
| | A | B | 1 | 2 | 3 | 4 |
| Type of paper: | 1 minute ink flotation test: (IFT values): | | | | | |
| (a) alum-free | 0.4 | 3 | 2–3 | 3 | 2 | 3 |
| (b) alum-containing | 0.2 | 4 | 2 | 3 | 3 | 3 |
| (c) pre-sized | 0.2 | 3 | 1–2 | 2 | 2 | 3 |
| (d) chalk-containing | 0.4 | 3 | 3 | 3 | 4 | 4 |
| (e) wood-containing | 0.2 | 4 | 2 | 3 | 3 | 3 |

The Lables A B, 1, 2, 3 and 4 have the same meaning as given under Table 2.

The expresion IFT value designates the assessment in the ink flotation test at the application concentrations used. In this test, the papers are finished with the sizing liquor of the above concentration, dried as described above, conditioned and placed on top of test ink (DIN 53,126). The test papers have the dimensions of 7 cm×3 cm. The ink is allowed to act on the underside of the paper for a set time (60 seconds), and the extent is then assessed to which the ink has struck through to the top side of the test piece. 1 denotes no penetration, and 5 denotes complete penetration. The transition values are given proportional values between these two extremes.

We claim:

1. Paper-size formulations containing in an aqueous alkaline dispersion products which are obtainable by reacting $\alpha$, $\beta$-unsaturated carboxylic acids having 3 to 10 atoms or their halides, esters or partial esters with lower alcohols having 1 to 6 C atoms, and in the case of dicarboxylic acids their anhydrides with amide-amines of higher carboxylic acids at temperatures above 120° C., said amide-amines being obtainable by reacting 2 mols of aromatic, aliphatic and cyclic carboxylic acids having 10–26 C atoms with 1 mol of diethylenetriamine, triethylenetetramine, tetraethylenepentamine or pentaethylenehexamine.

2. Paper size formulations according to claim 1, wherein the amide-amines are obtainable by reacting the carboxylic acid with triethylenetetramine.

3. Paper-size formulations according to claim 1, wherein said temperatures are above 140° C.

4. Paper-size formulations according to claim 1, wherein said temperatures are 120° C. to 150° C.

5. Paper-size formulations according to claim 1, wherein said temperatures are 130° C. to 170° C.

6. Paper-size formulations according to claim 1, wherein protective gas is employed during said reacting.

7. Paper-size formulations according to claim 1, wherein said $\alpha$, $\beta$-unsaturated carboxylic acids or their esters or anhydrides are selected from the group consisting of acrylic acid, methacrylic acid, maleic acid, maleic anhydride, fumaric acid, maleates and mixtures thereof.

8. Paper-size formulations according to claim 1, wherein said $\alpha$, $\beta$-unsaturated carboxylic acids or their esters or anhydrides are selected from the group consisting of maleic acid, maleic anhydride and mixtures thereof.

9. Paper-size formulations according to claim 1, wherein said acid amides are amides of resin acids.

10. Paper-size formulations according to claim 1, wherein said acid amides are selected from the group consisting of amides of aliphatic fatty acids having 10 to 26 C atoms, natural fatty acids having 10 to 26 C atoms and mixtures thereof.

11. Paper-size formulations according to claim 1, wherein said acid amides are selected from the group consisting of amides of aliphatic fatty acids having 12 to 18 C atoms, natural fatty acids having 12 to 18 C atoms and mixtures thereof.

12. Paper-size formulations according to claim 1, wherein said acid amides are acid amides of fatty acids, said fatty acids having melting points above 30° C.

13. Paper-size formulations according to claim 1, wherein said acid amides are obtained by reacting triethylenetetramine and stearic acid, or carboxylic acid, mixtures which contain stearic acid.

14. Paper-size formulations according to claim 1, wherein the products obtainable by reacting $\alpha$, $\beta$-unsaturated carboxylic acids with acid amides have mean molecular weights of about 500 to about 3,500, determined by the osmotic molecular weight determination method.

15. Paper-size formulations according to claim 1, wherein said dispersions are ammonical.

16. Paper-size formulations according to claim 1, wherein said dispersions contain active ingredient concentrations of 5 to 40 percent by weight.

17. Paper-size formulations according to claim 1, wherein said dispersions contain active ingredient concentrations of 10 to 25 percent by weight.

18. In a paper-sizing process including contacting paper with liquor containing paper-size formulation, the improvement wherein said paper-size formulation is according to claim 1.

* * * * *